United States Patent [19]

Welters

[11] 4,338,774

[45] Jul. 13, 1982

[54] YARN BRAKE

[75] Inventor: Norbert Welters, Monchen-Gladbach, Fed. Rep. of Germany

[73] Assignee: Palitex Project Company GmbH, Krefeld, Fed. Rep. of Germany

[21] Appl. No.: 150,054

[22] Filed: May 15, 1980

[30] Foreign Application Priority Data

Jun. 9, 1979 [DE] Fed. Rep. of Germany ..... 2923426

[51] Int. Cl.[3] ..... D01H 7/86; D01H 13/10; D01H 15/00; B65H 59/12

[52] U.S. Cl. ..... 57/58.86; 57/279; 242/149

[58] Field of Search ..... 57/58.49, 58.7, 58.87, 57/58.86, 279, 280, 352; 242/147 R, 149, 150 R, 156

[56] References Cited

U.S. PATENT DOCUMENTS

| | | | |
|---|---|---|---|
| 2,291,819 | 8/1942 | McCann | 57/279 |
| 2,485,776 | 10/1949 | Roberts | 57/279 |
| 2,646,942 | 7/1953 | Heffelfinger | 242/149 |
| 2,718,363 | 9/1955 | Roberts | 242/149 |
| 2,736,511 | 2/1956 | Roberts | 57/58.86 X |
| 2,785,526 | 3/1957 | Keith | 57/58.86 |
| 3,165,882 | 1/1965 | Kreuschmer | 57/58.83 |
| 3,383,072 | 5/1968 | Horvath | 242/149 |
| 3,490,221 | 1/1970 | Heimes et al. | 57/58.86 |
| 3,945,184 | 3/1976 | Franzen | 57/279 X |
| 3,975,893 | 8/1976 | Franzen | 57/279 |

FOREIGN PATENT DOCUMENTS

| | | |
|---|---|---|
| 968222 | 1/1958 | Fed. Rep. of Germany . |
| 1510807 | 12/1970 | Fed. Rep. of Germany . |
| 2309578 | 9/1974 | Fed. Rep. of Germany . |
| 2455242 | 5/1976 | Fed. Rep. of Germany . |
| 2543018 | 12/1977 | Fed. Rep. of Germany . |
| 1505744 | 3/1978 | United Kingdom . |

*Primary Examiner*—John Petrakes

*Attorney, Agent, or Firm*—Bell, Seltzer, Park & Gibson

[57] ABSTRACT

A yarn brake for applying tension to a yarn at the entrance end of a tube as the yarn moves through the tube and which may be utilized in a hollow spindle assembly of a textile yarn processing machine, such as a two-for-one twister. The yarn brake includes a first braking surface formed on a yarn entrance end of the tube and a movable brake member resting on the yarn entrance end of the tube and having a second braking surface on the underside thereof for cooperating with the first braking surface to apply tension to the yarn moving therebetween. The yarn brake includes a threading slot formed in the entrance end of the tube for threading of the yarn through the tube without moving the braking member from the entrance end of the tube.

12 Claims, 3 Drawing Figures

YARN BRAKE

FIELD OF THE INVENTION

This invention relates to a yarn brake for applying tension to a yarn at the entrance end of a tube as the yarn moves through the tube. The yarn brake includes a first braking surface formed on a yarn entrance end of the tube and a movable brake member resting on the entrance end of the tube and having a second braking surface on the underside thereof for engaging the first braking surface to apply tension to the yarn moving therebetween. The yarn brake has provisions therein for threading of the yarn through the tube without moving the braking member from the entrance end of the tube.

BACKGROUND OF THE INVENTION

Yarn brakes of the above described type are utilized particularly in conjunction with two-for-one twister textile yarn processing machines, as disclosed in German Pat. No. 968,222 and U.S. Pat. No. 2,718,363. However, such yarn brakes may also be utilized in other environments, such as for example with any hollow spindle, bobbin adapter and the like, wherein yarn is fed through a tube and tension is to be applied thereto.

In two-for-one twister textile yarn processing machines, the yarn brake of the above-described type may act either as the sole tensioning device for the yarn passing through the hollow spindle or, as is more frequently the case, may act as an initial tensioning mechanism which precedes a further yarn brake tensioning mechanism of the type utilizing capsules or platelets for tensioning of the yarn within the hollow spindle of the machine, as is well known to those with ordinary skill in the art.

Moreover, in modern day textile yarn processing machines, particularly two-for-one twisters, threading of the yarn through the hollow spindle assembly is often performed pneumatically by mechanisms, such as disclosed in commonly-assigned U.S. Pat. Nos. 3,945,184 or 3,975,893. With the use of such pneumatic threading mechanisms, the brake member of the yarn brake must be moved away from the upper end of the tube or some other provision for threading provided.

SUMMARY OF THE INVENTION

With the foregoing in mind, it is the object of this invention to provide a yarn brake of the above discussed type which includes a means for threading of the yarn through the tube of the yarn brake without the necessity of removing the brake member from the entrance end of the tube.

It has been found by this invention that the above object may be accomplished by providing a slot means in the tube at its yarn entrance end for receiving a yarn during a threading operation of the yarn into and through the tube without requiring movement of the braking member from the entrance end of the tube, while allowing the yarn to pass from the slot means into tensioning position between the braking surfaces of the yarn brake upon continued movement of the yarn.

In accordance with the preferred embodiment of this invention, the slot means extends from the outside to the inside and in a partial spiral around a part of the circumference of the body of the tube and slopes circumferentially to the upper end of the tube to define a bottom wall, a top wall and an inside wall. The slot decreases in height between the bottom wall and the top wall from the outside to the inside of the tube and decreases in depth from the inside wall to the opening of the slot in the circumferential direction to the entrance or upper end of the tube. In order to allow the yarn to move in the region of the upper edge or entrance end of the tube without suffering damage, the edges of the slot means in the upper or entrance end of the tube are preferably radiused.

This improved slot means is particularly suitable for use in a yarn brake in which the tube includes an inwardly projecting constriction in the interior passageway of the tube and the brake member is in the form of a disc having a guide stem extending from the underside of the disc and projecting axially into the interior passageway of the tube through the constriction and having a thickened member on the end of the stem of slightly larger dimensions than the constriction for retaining the brake disc in position and preventing it from falling out of braking position with the tube, while allowing some axial movement thereof for passage of the yarn between braking surfaces.

This yarn brake of the present invention is also particularly adaptable for use in a hollow spindle assembly of a textile yarn processing machine, particularly a two-for-one twister at the entrance end of the yarn entry tube thereof, and which includes pneumatic threading mechanisms for creating a pneumatic flow through the yarn passageway of the hollow spindle assembly of such textile yarn processing machine.

BRIEF DESCRIPTION OF THE DRAWINGS

Some of the objects and advantages of this invention having been stated, other objects and advantages will become apparent as the description proceeds, when taken in conjunction with the accompanying drawings, in which.

DESCRIPTION OF THE ILLUSTRATED EMBODIMENT

Figure 1:
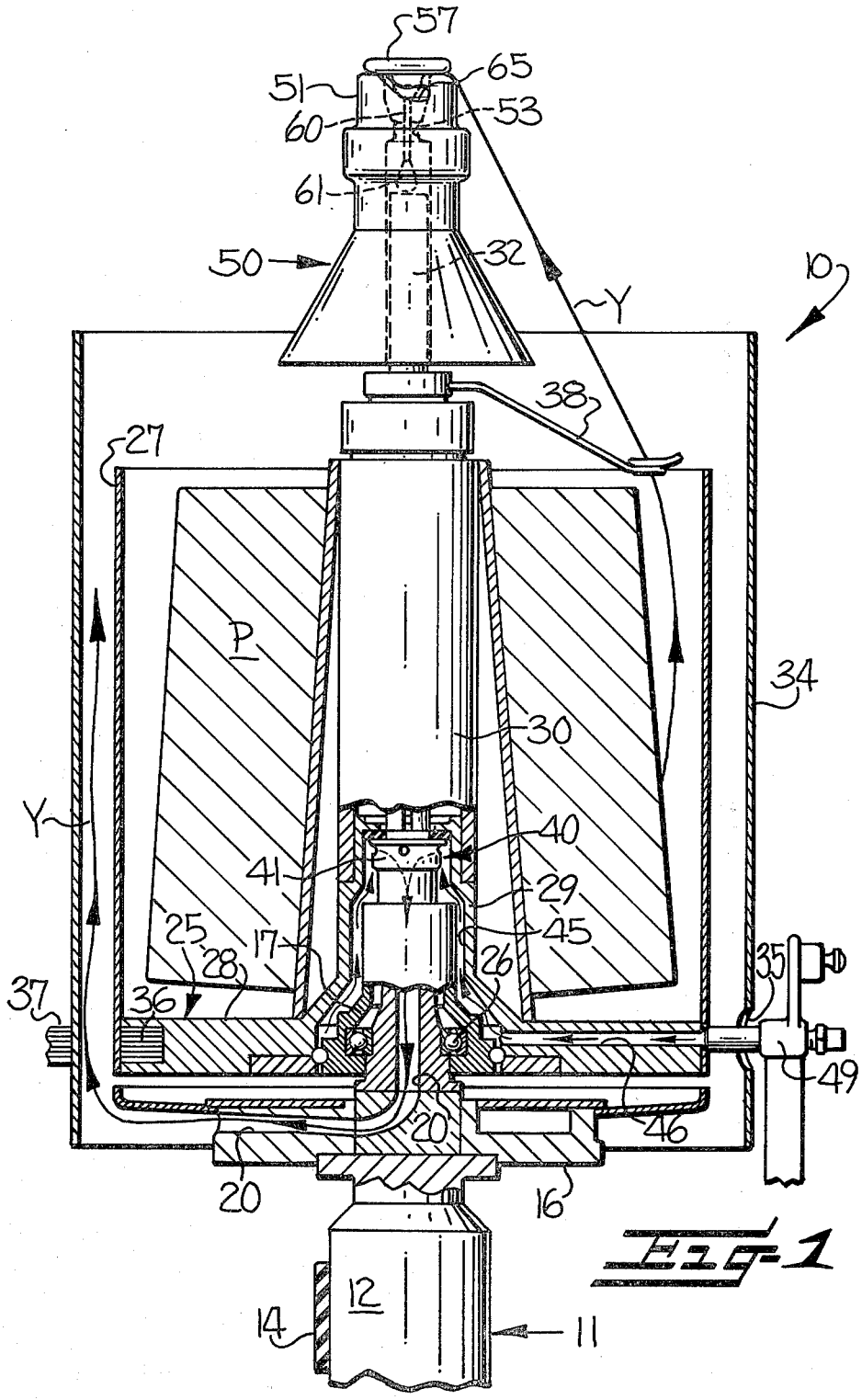
FIG. 1 is a cross-sectional, elevational view of one spindle assembly of a two-for-one twister textile yarn processing machine utilizing the yarn brake of this invention.

Referring now more particularly to the drawings, the yarn brake of this invention is generally indicated by the reference numeral 50. For purposes of illustration, the yarn brake 50 is shown as part of a spindle assembly of a two-for-one twister textile yarn processing machine. While this is a preferred environment for the use of the yarn brake 50, such yarn brake 50 may also be utilized in other environments and in other textile machines of a different nature, wherein a moving yarn is passed through a tube and tension is desired to be placed upon the moving yarn, as discussed above.

Referring now to FIG. 1, there is illustrated therein a schematic cross-sectional view of a single spindle assembly station, generally indicated at 10 of a two-for-one twister textile yarn processing machine. It is to be understood that a plurality of these spindle assembly stations 10 are provided in side-by-side relationship in two full rows along the outside of the machine. A full illustration and description of the entire two-for-one twister textile yarn processing machine is not given herein and is not believed to be necessary for an understanding of the present invention, the operation and complete structure of such a two-for-one twister being well understood by those with ordinary skill in the art.

Generally, each spindle assembly station 10 comprises a rotatably driven rotor mechanism, generally indicated at 11, which includes a whorl 12 suitably rotatably mounted on a portion of the twister frame (not shown) and rotated by continuous tangential drive belt 14 in a manner well understood by those with ordinary skill in the art. The rotor mechanism 11 further includes a horizontally-extending yarn reserve disc 16 secured to the whorl 12 for rotation therewith in a generally vertically-extending hollow axle 17 which also rotates with the reserve disc 16. The reserve disc 16 and hollow axle 17 define therewithin a generally L-shaped yarn passageway 20 extending generally vertically through the hollow axle 17 and a portion of the yarn reserve disc 16 and generally horizontally and radially out of the yarn reserve disc 16. The spindle assembly 10 further includes a stationary carrier mechanism, generally indicated at 25, for supporting and carrying a hollow supply package P of yarn Y. The carrier mechanism 25 is mounted on the rotor mechanism 11 by bearings 26 so that the rotor mechanism 11 may rotate relative to the stationary carrier mechanism 25. The carrier mechanism 25 includes a basket device 27 which surrounds the package P, a circular bottom portion 28 for supporting the hollow yarn supply package P and a hollow tubular hub portion 29 extending upwardly into the hollow yarn supply package P for stabilizing the yarn supply package P. A tubular housing 30 is carried by and extends upwardly from the upper end of the hub portion 29 and contains a portion of the pneumatic yarn threading mechanisms 40, to be described more fully hereinafter.

A yarn entry tube 32 has an axially extending passageway 33 (see FIG. 2) for receiving and allowing passage of the yarn Y therethrough. This yarn entry tube 32 is mounted on the tubular housing 30 and the yarn passageway 33 communicates with a passageway through the tubular housing 30 and the yarn passageway 20 to collectively provide a continuous yarn passageway extending through the spindle assembly 10.

There is further provided a balloon limitor 34 surrounding the basket 27 so as to contain a balloon of yarn Y formed around the outside of the basket 27. The balloon limitor 34 has an aperture 35 therein for purposes to be described below. In order to maintain the textile yarn package carrier mechanism 25 stationary during rotation of the rotor mechanism 11, there are provided magnets 36 carried by the bottom portion 28 and cooperating with magnets 37 carried by the balloon limitor 34 to prevent rotation of the carrier mechanism 25.

The spindle assembly 10 further includes a flyer mechanism 38 mounted on the yarn entry tube 32 for free rotation about the axis of the spindle assembly 10. There is also provided a take-up mechanism (not shown) including a yarn take-up or package roll upon which the yarn Y is wound after being processed by the spindle assembly station 10. The take-up mechanism is conventional in a two-for-one twister and an illustration thereof and further explanation is not believed necessary for a full understanding of this invention.

With the above-described mechanisms of the spindle assembly 10, the yarn Y passes from the package P, through the rotating flyer mechanism 38, through the yarn brake 50 (to be described hereinafter) and into the yarn entry tube 32. The yarn Y then passes downwardly through the collective yarn passageway 33, 20 and emerges from the yarn reserve disc 16 in a generally horizontal direction. The yarn Y then passes upwardly between the basket 27 and the balloon limitor 34 and forms a rotating balloon of yarn which is contained by the balloon limitor 34. The yarn Y then passes upwardly to the take-up mechanism (not shown) to complete its travel through the respective spindle assembly station 10. As is well understood by those with ordinary skill in the art, a two-for-one twist is inserted into the yarn Y during the above noted path of travel.

To assist in threading the yarn from the package P through the respective passageways 33, 20 of the hollow spindle assembly 10, during a periodic thread-up operation when rotation of the rotor mechanism 11 is stopped, the spindle assembly 10 is provided with pneumatically operated yarn threading mechanisms 40. As mentioned above, these yarn threading mechanism 40 may be generally in accordance with commonly assigned prior U.S. Pat. Nos. 3,945,184 or 3,975,893 and as illustrated herein are generally in the form described in U.S. Pat. No. 3,975,893.

The yarn threading mechanisms 40 include generally an air injector nozzle 41 which receives compressed air from an air duct 46 through a passageway 45 to produce a suction or negative air flow through the passageway 33 of the yarn entry tube 32 and a positive air flow through the passageway 20 through the hollow axle 17 and reserve disc 16. Compressed air may be selectively supplied to the air duct 46 during a thread-up operation by suitable means, such as by a selectively movable connector member 49 positioned for movement into and out of connecting engagement with the entrance to the air duct 46 through the aperture 35.

When the threading mechanisms 40 are operated in the above-described manner, a yarn Y which is withdrawn from the package P and placed near the entrance to the yarn entry tube 32 will be sucked through the passageway 33 and then blown out through the passageway 20 for threading through the hollow spindle assembly 10.

In accordance with the present invention, the yarn brake 50 is positioned at the entrance end to the yarn entry tube 32 and may be in the form of a separate adapter on such yarn entry tube 32, as illustrated in the drawings herein, or the yarn entry tube 32 may itself form part of the yarn brake 50.

The yarn brake 50 comprises a generally vertically-extending tube 51 which, as discussed above, may be a separate adapter tube telescopically positioned over the yarn entry tube 32 to form a collective yarn entry tube 51, 32 as illustrated in the drawings, or may constitute the yarn entry tube 32 alone.

This vertically-extending tube 51 includes an interior yarn passageway 52 which communicates with and forms an extension of the passageway 33 for the passage of the yarn Y therethrough. There is also provided an inwardly projecting constriction 53 in the interior passageway 52 of the tube 51. A first braking surface 55 is formed on the upper or outer end of the tube 51.

A movable brake member 57, preferably in the form of a disc, rests on the upper or outer end of the tube 51 and includes a second braking surface 58 formed on the underside of the brake disc 57 for engaging and cooperating with the braking surface 55 to define a yarn tensioning passageway therebetween to apply tension to the moving yarn Y as it passes between these first and second braking surfaces 55, 58 upon entering the tube 51 and hollow spindle assembly 10 for applying an initial tension to the yarn Y.

The brake disc 57 preferably includes a guide stem 60 extending from the underside of the brake disc 57 and projecting axially into the interior passageway 52 of the tube 51 and through the constriction 53. The guide stem 60 includes a thickened member 61, which may be somewhat resilient, on the lower end of the stem of slightly larger dimensions than the constriction 53. The thickened member 61 is forced through the constriction 63, to retain the brake disc 57 in position on the outer end of the tube 51 and the braking surface 55, while allowing some axial movement of the brake disc 57 to accommodate the yarn Y passing through the braking surfaces 55, 58.

The yarn brake 50 further includes a threading slot 65 extending through one side of the tube 51 from the outside to the inside thereof and which communicates with the yarn tensioning passageway between the braking surfaces 55, 58 for receiving a yarn Y during a threading operation of the yarn Y without requiring movement of the braking disc 57 from the upper end of the tube 51. This slot 65 preferably extends in a partial spiral around part of the circumference of the tube 51 from the inside to the outside of the tube 51 and slopes circumferentially to the upper end of the tube 51 to define a bottom wall 65', a top wall 65'' and an inside wall 65'''. The slot 65 decreases in height between the bottom wall 65' and the top wall 65'' from the outside to the inside of the tube 51 and decreases in depth from the inside wall 65''' to the opening of the slot 65 in the circumferential direction to the upper end of the tube 51, as may be clearly seen in FIGS. 2 and 3.

Figure 2:
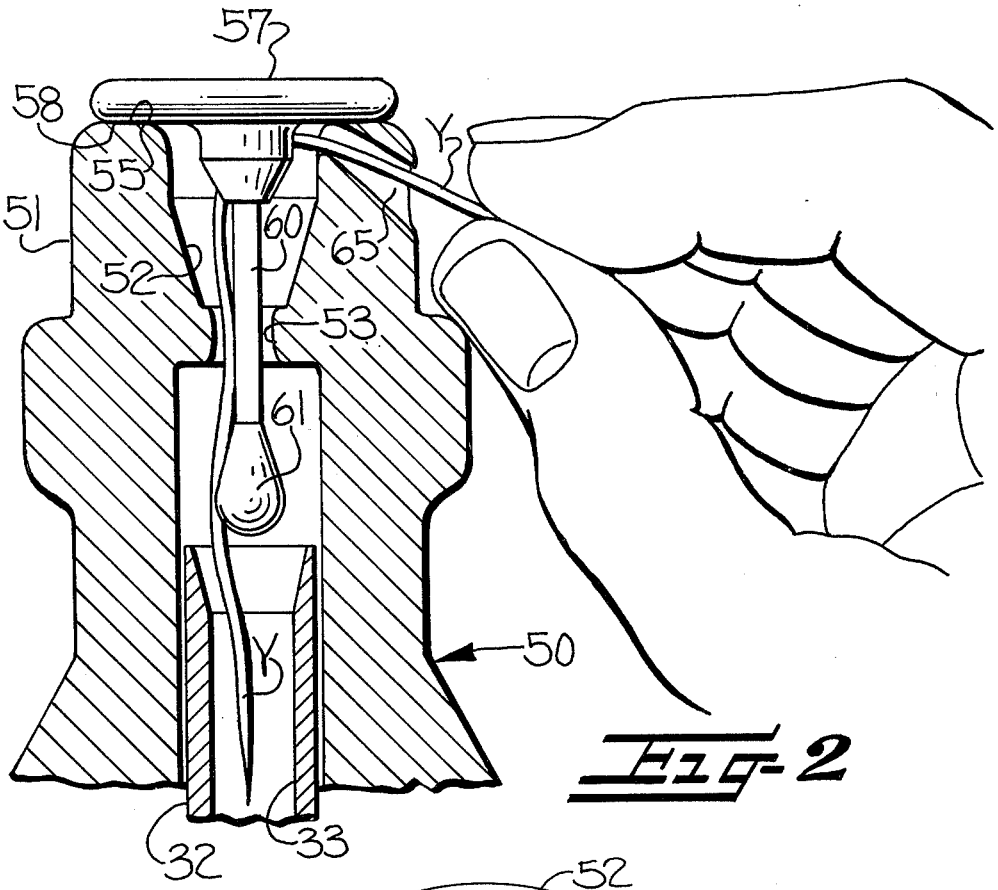
FIG. 2 is an enlarged, partial, cross-sectional view through the yarn brake illustrated in FIG. 1 and showing a threading-up operation.
Figure 3:
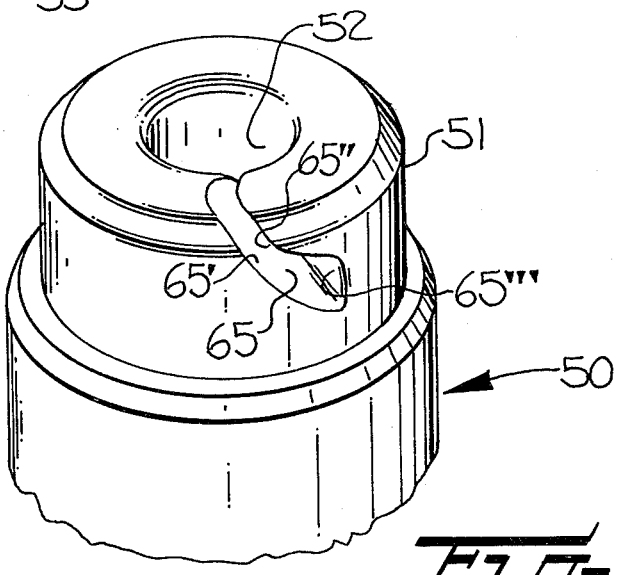
FIG. 3 is a partial, perspective view of the yarn brake illustrated in FIG. 2 with the brake disc removed therefrom.

With this arrangement of a slot 65, when the pneumatic threading mechanisms 40 of the spindle assembly 10 are actuated, a suction is created through the passageway 52 of the tube 51 and through the slot 65 so that an operator may simply position a yarn end at the slot 65, as indicated in FIG. 2, and suction will draw the yarn end through the slot 65 and into the passageway 52 for continued travel through the passageways 33, 20 of the spindle assembly 10, as described above.

The yarn Y may then be released by the operator and when the spindle assembly 10 is started up and movement of the yarn Y commenced in the direction of the slot, the yarn Y will work its way out of the slot 65 and position itself between the braking surfaces 55, 58 of the yarn brake 50, as indicated in FIG. 1. To prevent damage to the yarn Y as it moves around the braking surfaces 55, 58, the edges of the slot 65 in the upper end of the tube 51 are radiused.

In the drawings and specification, there has been set forth a preferred embodiment of the invention, and although specific terms are employed, they are used in a generic and descriptive sense only and not for purposes of limitation.

What is claimed is:

1. In a yarn brake, for applying tension to a moving yarn, comprising a tube through which the moving yarn passes and having a first braking surface formed on a yarn entrance end of said tube, and a movable brake member resting on the entrance end of said tube and having a second braking surface on the underside thereof for cooperating with said first braking surface to define a yarn tensioning passageway therebetween to apply tension to the moving yarn as the yarn passes between said first and second braking surfaces upon entering said tube; the improvement of:

means formed in said tube at the yarn entrance end of said tube defining a slot extending through one side of said tube from the outside to the inside thereof and in communication with said yarn tensioning passageway for receiving a yarn during a threading operation of the yarn into and through said tube without requiring movement of said braking member from the entrance end of said tube, while allowing the yarn to pass from said slot into said tensioning passageway between said first and second braking surfaces upon continued movement of the yarn.

2. In a yarn brake, as set forth in claim 1, in which said slot extends in a partial spiral around a part of the circumference of said tube from the inside to the outside of said tube and slopes circumferentially to the entrance end of said tube to define a bottom wall, a top wall and an inside wall.

3. In a yarn brake, as set forth in claim 2, in which said slot means decreases in height between said bottom wall and said top wall from the outside to the inside of said tube.

4. In a yarn brake, as set forth in claim 3, in which said slot means decreases in depth from said inside wall to the opening of said slot in the circumferential direction to said yarn tensioning passageway between said braking surfaces.

5. In a yarn brake, as set forth in claim 1, 2, 3 or 4, in which the edges of said slot means in the entrance end of said tube are radiused.

6. A yarn brake for applying tension to a moving yarn comprising:

a generally vertically-extending tube through which the moving yarn passes and including an inwardly projecting constriction in the interior passageway of said tube and a first braking surface formed on the upper end of said tube;

a movable brake disc resting on the upper end of said tube and including a second braking surface formed on the underside of said brake disc for cooperating with said first braking surface to define a yarn tensioning passageway therebetween to apply tension to the moving yarn as the yarn passes between said first and second braking surfaces upon entering said tube, and a guide stem extending from the underside of said brake disc and projecting axially into the interior passageway of said tube through said constriction and having a thickened member on the end of said stem of slightly larger dimensions than said constriction for retaining said brake disc in position while allowing some axial movement thereof; and means formed in the upper end of said tube defining a slot extending through one side of said tube from the outside to the inside thereof and in communication with said yarn tensioning passageway for receiving a yarn during a threading operation of the yarn into and through said tube without requiring movement of said braking disc from the upper end of said tube, while allowing the yarn to pass from said slot into said tensioning passageway between said first and second braking surfaces upon continued movement of the yarn.

7. A yarn brake, as set forth in claim 6, in which said slot means extends in a partial spiral around a part of the circumference of said tube from the outside to the inside of said tube and slopes circumferentially to the upper end of said tube to define a bottom wall, a top wall and an inside wall, said tube decreases in height between said bottom wall and said top wall from the outside to the inside of said tube and decreases in depth from said inside wall to the opening of said slot in the circumferential direction to said yarn tensioning passageway between said braking surfaces.

8. A yarn brake, as set forth in claim 6 or 7, in which the edges of said slot means in the upper end of said tube are radiused.

9. In a spindle assembly of a textile yarn processing machine, particularly a two-for-one twister, having a generally vertically and axially extending yarn passageway therethrough and yarn entry tube means positioned at the upper end of said passageway and forming a part of said passageway and including a pneumatic threading mechanism for creating a pneumatic flow in said yarn passageway including a suction in said yarn entry tube means to automatically thread a yarn therethrough during thread-up operation; the combination therewith of a yarn brake for applying tension to a yarn moving through said spindle assembly and comprising:

a first braking surface formed on the upper end of said yarn entry tube;

a movable brake member resting on the upper end of said tube and having a second braking surface on the underside thereof for cooperating with said first braking surface to define a yarn tensioning passageway therebetween to apply tension to the moving yarn as the yarn passes between said first and second braking surfaces upon entering said yarn entry tube; and means formed in said tube at the upper end of said tube defining a slot extending through one side of said tube from the outside to the inside thereof and in communication with said yarn tensioning passageway for receiving by suction a yarn during a pneumatic threading operation of the yarn into and through said tube without requiring movement of said braking member from the upper end of said tube, while allowing the yarn to pass from said slot into said tensioning passageway between said first and second braking members upon movement of the yarn during operation of said spindle assembly.

10. In a spindle assembly, as set forth in claim 9 in which said yarn brake further includes an adapter tube telescopically positioned on and forming the upper end of said tube means.

11. In a spindle assembly, as set forth in claim 9, in which said slot means extends in a partial spiral around a part of the circumference of the body of said tube means from the outside to the inside and slopes circumferentially to the upper end of said tube to define a bottom wall, a top wall and an inside wall, said tube decreases in height between said bottom wall and said top wall from the outside to the inside of said tube means and decreases in depth from said inside wall to the opening of said slot in the circumferential direction to said yarn tensioning passageway, and in which the edges of said slot means in the upper end of said tube are radiused.

12. In a spindle assembly, as set forth in claim 9, 10 or 11, in which said yarn entry tube includes an inwardly projecting constriction in the interior passageway of said tube, and said movable brake member comprises a disc having a guide stem extending from the underside of said disc and projecting axially into the interior passageway of said tube through said restriction and having a thickened member on the end of said stem of slightly larger dimensions than said constriction for retaining said brake disc in position while allowing some axial movement thereof.

* * * * *